US006790332B2

(12) United States Patent
Ewald et al.

(10) Patent No.: US 6,790,332 B2
(45) Date of Patent: Sep. 14, 2004

(54) METHOD FOR THE GALVANIC DEPOSITION OF NICKEL, COBALT, NICKEL ALLOYS OR COBALT ALLOYS WITH PERIODIC CURRENT PULSES

(75) Inventors: Rüdiger Ewald, Beilngries (DE); Peter Filke, Kirchseeon (DE); Michael Heckmann, Steinhöring (DE); Wolfgang Keinath, Höhenkirchen-Siegertsbrunn (DE); Günter Langel, München (DE); Anton Schmidt, Seeon (DE)

(73) Assignee: Astrium GmbH, Munich (DE)

( * ) Notice: Subject to any disclaimer, the term of this patent is extended or adjusted under 35 U.S.C. 154(b) by 271 days.

(21) Appl. No.: 10/011,269

(22) Filed: Dec. 7, 2001

(65) Prior Publication Data

US 2002/0084190 A1 Jul. 4, 2002

(30) Foreign Application Priority Data

Dec. 7, 2000 (DE) ..... 100 61 186

(51) Int. Cl.[7] ..... C25D 5/18

(52) U.S. Cl. ..... 205/96; 205/97; 205/99; 205/101; 205/103; 205/255; 205/269; 205/271

(58) Field of Search ..... 205/96, 97, 99, 205/101, 103, 148, 255, 269, 271

(56) References Cited

U.S. PATENT DOCUMENTS 2,470,775 A 5/1949 Jernstedt et al. ..... 204/43
3,915,835 A 10/1975 Cordone et al.
6,036,833 A * 3/2000 Tang et al. ..... 205/103
6,071,398 A * 6/2000 Martin et al. ..... 205/103
6,099,711 A * 8/2000 Dahms et al. ..... 205/101
6,210,555 B1 * 4/2001 Taylor et al. ..... 205/103

FOREIGN PATENT DOCUMENTS

DE 2 218 967 4/1972
DE 25 58 423 12/1975
EP 0 835 335 6/1996

OTHER PUBLICATIONS

F. A. Lowenheim, Electroplating, McGraw–Hill Book Company, New York, 1978, pp. 12–15.*

* cited by examiner

*Primary Examiner*—Roy King
*Assistant Examiner*—William T. Leader
(74) *Attorney, Agent, or Firm*—Crowell & Moring LLP

(57) ABSTRACT

A method for galvanically depositing nickel, cobalt, nickel alloys or cobalt alloys in a galvanic bath includes using electrolytes containing nickel compounds or cobalt compounds. At least one anode and at least one cathode of the bath are subject to periodic current pulses. The $I_A/I_C$ ratio of the anode current density $I_A$ to the cathode current density $I_C$ is selected to be greater than 1 and smaller than 1.5, where the anode current density $I_A$ and the cathode current density $I_C$ are defined as current densities with respect to a deposition body on which deposition occurs during the application of periodic current pulses where the deposition body serves as anode and cathode respectively. The charge ratio $Q_A/Q_C = T_A I_A / T_C I_C$ of the charge $Q_A$, transported during anode pulse of duration $T_A$, to the charge $Q_C$ transported during a cathode pulse of duration $T_C$, is between 30% and 45%. A bath for carrying out the method may have contoured anodes, current restrictors, a cleaning device for the electrolyte, and a circulating device with recycling of the electrolyte through nozzles.

19 Claims, 2 Drawing Sheets

FIG. 2
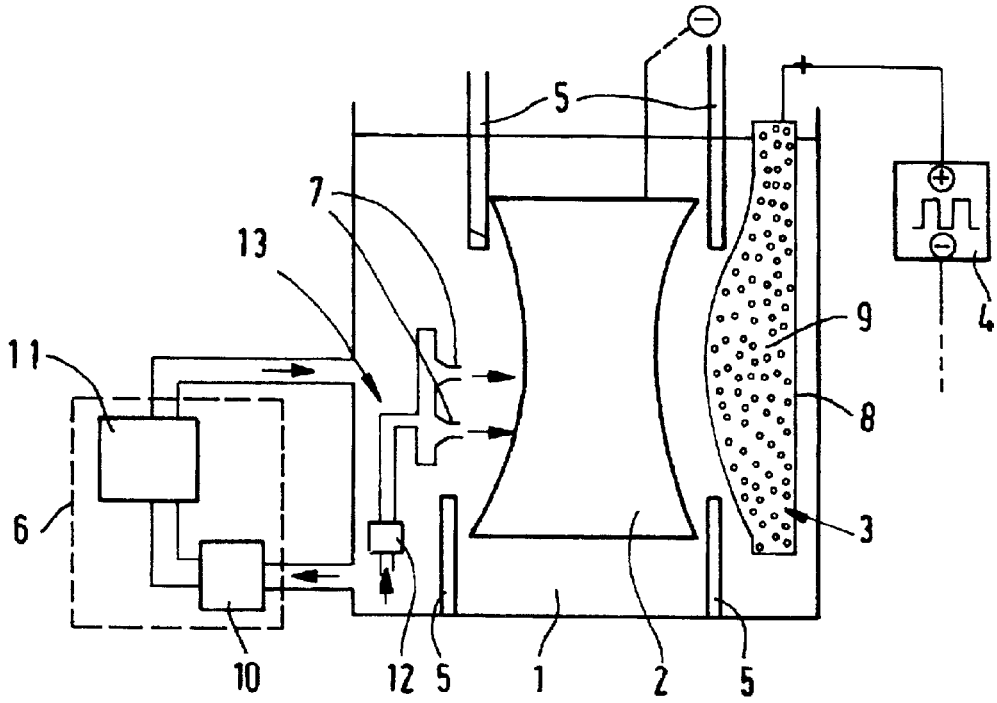
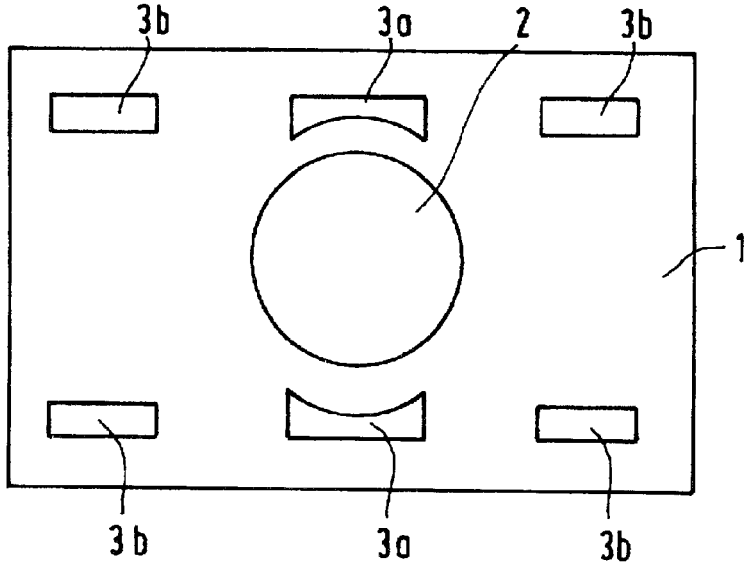
FIG. 3

METHOD FOR THE GALVANIC DEPOSITION OF NICKEL, COBALT, NICKEL ALLOYS OR COBALT ALLOYS WITH PERIODIC CURRENT PULSES

This application claims the priority of German patent document 100 61 186.9, filed Dec. 7, 2000, the disclosure of which is expressly incorporated by reference herein.

BACKGROUND AND SUMMARY OF INVENTION

The present invention relates to a method for the galvanic deposition of nickel, cobalt, nickel alloys, or cobalt alloys in a galvanic bath, using an electrolyte containing nickel compounds or cobalt compounds, such as sulfates or sulfamates or chlorides. Such electrolytes for galvanic deposition are known, for example from the German patents DE 25 58 423 and DE 22 18 967 (U.S. Pat. No. 3,726,768); U.S. Pat. No. 2,470,775; and European Patent 0 835 335 (U.S. Pat. No. 6,036,833). For the deposition, at least one anode and at least one cathode of the bath is acted upon with periodic current pulses. Such methods with the help of current pulses are known from the state of the art, for example, from U.S. Pat. No. 2,470,775 and European Patent 0 835 335.

With such methods, nickel, cobalt, nickel alloys or cobalt alloys basically can be deposited in one galvanic bath. However, a special problem arises when the components, which are to be produced by such a deposition, should have particular mechanical properties, such as a specified strength or a specified ductility.

Such a problem arises particularly when the component that is to be produced is to be joined indissolubly later on, for example, by welding to other components. For this purpose, the ductility usually must meet certain minimum requirements, so that a welded joint can be realized between a galvanically produced nickel or cobalt layer or layer of any nickel or cobalt alloy and other components with sufficient strength and durability of the welded joint. However, if the ductility of the layer that is to be welded is too high, the strength of the corresponding layer is decreased. The corresponding layer, under some circumstances, no longer satisfies the specified requirements with regard to mechanical load-carrying capability. This is true particularly for components that are to be exposed to relatively high stresses such as to those that can occur in components of rocket engines. The thrust chambers of rocket engines, which consist essentially of components such as the injection head, combustion chamber and thrust nozzle, should be especially mentioned in this connection.

It has turned out that the methods, known from the art, cannot guarantee the necessary properties of the deposited layers of nickel or cobalt or of nickel alloys or cobalt alloys, which are an indispensable prerequisite for an indissoluble connection, especially by welding, of such a layer to other components, for example, those of an alloy based on iron or nickel.

It is therefore an object of the present invention to provide a method for the galvanic deposition of nickel, cobalt, nickel alloys, or cobalt alloys in a galvanic bath. At least one anode and at least one cathode of the bath are acted upon with periodic current pulses. Layers of nickel or cobalt or of nickel alloys or cobalt alloys can be produced, which can be connected indissolubly to other components and especially welded to other components.

This objective is accomplished according to preferred embodiments of the present invention.

In the case of a method for the galvanic deposition of nickel, cobalt, nickel alloys or cobalt alloys in a galvanic bath according to the present invention, an electrolyte is u d that contains appropriate nickel compounds or cobalt compounds, particularly sulfate or sulfamates or chloride. For the deposition, at least one anode and at least one cathode of the bath is acted upon with periodic current pulses, that is, a so-called plating method is used. Normally, a deposition body n which a layer of the appropriate material is to be deposited acts as cathode. Pursuant to the present invention, the $I_A/I_c$ ratio of the anode current density $I_A$ to the cathode current density $I_C$ is selected to be greater than 1 and smaller an 1.5. The charge ratio $Q_A/Q_C=T_AI_A/T_CI_C$ of the charge $Q_A$, transported dun g an anode pulse of duration $T_A$, to the charge $Q_C$, transported during a cathode pulse of duration $T_C$, is between 30% and 45%.

It has turned out that the properties, especially with regard to the strength and ductility of the layer, which are necessary for an indissoluble connection of the deposited layer to other components, can be achieved only if such a ratio is selected. According to EP 0 835 335, on the other hand, it is proposed in particular, that an $I_A/I_C$ ratio be selected that is at least 1.5. This document does not go into suitable parameter ranges for achieving a layer with the aforementioned properties. Furthermore, there is no mention there of selecting a suitable $Q_A/Q_C$ ratio.

In preferred embodiments, the $I_A/I_C$ ratio is between 1.2 and 1.45 and particularly between 1.3 and 1.4 and the charge ratio $Q_A/Q_C=T_AI_A/T_CI_C$ is between 35% and 40% For these ranges of the parameters, particularly advantageous properties of the deposited layer can be noted, especially with regard to the strength and the ductility.

In order to achieve improved and uniform deposition of the layer on a deposition body, which in the final analysis is also to the benefit of the load-carrying capability of the layer over its whole extent, provisions can be made for the deposition. At least one contoured anode is used, the contour of which is adapted to the contour of the deposition body on which the nickel, the cobalt, the nickel alloy or the cobalt alloy is to be deposited. In particular, an almost constant distance between the anode and the deposition body can be achieved over almost all of the contour of the deposition body by this matching of the anode contour. This makes a uniform deposition possible.

If several anodes are provided in the bath, a contoured anode is used for at least one of the anodes that is closest to the deposition body. The effect of contouring the anode is greater for the anodes closest to the deposition body than for anodes further removed. Anodes without contouring, which are less expensive in some cases and can be used independently of the special shape of the deposition body, can therefore be used for the anodes that are further removed. Accordingly, by this suitable combination of anodes, which have and have not been contoured, an optimum can be achieved with respect to the quality of the deposition as well as the expenditure required for this purpose.

To form the contoured anode, a contoured container, for example, may be used that is permeable to the ions of the deposited nickel or cobalt or nickel alloy or cobalt alloy and which is filled with bodies of nickel, cobalt or a nickel alloy or a cobalt alloy. Special containers for such bodies are known from German patent DE 25 58 423 in the form of titanium or plastic baskets, which are filled with nickel pellets. However, contouring of the container is not disclosed in that document.

In principle, as an alternative to such containers, a solid electrode body that has at least a coating of the nickel, cobalt, nickel alloy or cobalt alloy, which is to be deposited, or that consists even of solid nickel, cobalt, nickel alloy or cobalt alloy, can also be used as a contoured anode.

During the deposition process, it may be necessary to selectively affect the deposition, which is to take place differently for different regions of the deposition body. This affecting may take place additionally or also alternatively to the aforementioned measure of the contoured anodes. For this purpose, provisions can be made so that the deposition body is shielded partially by current restrictors at least during a portion of the total duration of the deposition. During the time in which the regions are shielded, less deposition is achieved in the shielded regions than in the unshielded regions. Layer properties, especially the thickness of the layer, but also, optionally, the mechanical properties of the layer on the deposition body can be affected locally.

In particular, the current restrictors can be disposed in those regions of the deposition body in which deposition takes place preferentially. A layer growth, which is excessive in comparison to that in other regions, can be prevented in these regions and accordingly a more homogeneous layer growth can be realized over the whole of the deposition body.

Provisions can also be made to remove interfering extraneous elements or other suspended particles from the bath, in order to obtain the cleanest possible electrolyte solution. For this purpose, the electrolytes may be purified with the help of activated charcoal and/or of hydrogen peroxide at least before the deposition is commenced. In particular, for purifying the electrodes, 0.5 g/L to 5 g/L and especially 1 g/L to 3 g/L of activated charcoal and 0.5 mL/L to 3 mL/L and especially 1 mL/L to 2 mL/L of hydrogen peroxide are used before the start of the deposition.

However, in order to guarantee not only the cleanest possible electrolyte solution at the start of the process by such a purification, but also to maintain this purity as far as possible over the whole of the process, the electrolytes can be purified alternatively or also additionally during the deposition. For this purpose, in a preferred embodiment of the present invention, the electrolytes are filtered during the deposition, for example, through activated charcoal and extraneous elements are removed from the electrolytes by a selective bath. Such a selective bath corresponds to a galvanic bath, in which a selective deposition of extraneous elements and, with that, their removal from the electrolyte is accomplished by a selective control of the currents. The purified electrolyte, then ideally contains only the desired elements: (1) in the case of a nickel electrolyte, ideally only nickel or nickel alloys in the aforementioned compounds, and (2) in the case of a cobalt electrolyte, ideally only cobalt or cobalt alloys in the aforementioned compounds. The purified electrolyte is then returned to the galvanic bath.

In addition, the electrolyte can be circulated by at least one circulating pump and recycled into the bath through nozzles. The nozzles can be constructed and disposed in the bath, so that circulation of the bath is favored by the nozzles and/or flow of electrolyte directed on to the deposition body is achieved. In this case, not only do the nozzles fulfill the purpose of circulating and recycling the electrolyte into the bath, but also, due to the optimized nature of the recycling, the deposition process in the bath is favored since an optimum mixing and a selective supplying of an electrolyte, which is as pure as possible, to the deposition body is guaranteed at all times.

The method according to the present invention is suitable for producing different components, which later on are to be connected indissolubly with other components, for example, by welding. However, the method is also particularly suitable for producing components that are exposed to high stresses. Such components are, for example, rocket engines. In this connection, the method can be used for producing injection heads and/or combustion chambers and/or thrust nozzles for rocket engines. However, the method can also be used for other components, that are subjected to high stresses during later operation and therefore must have a sufficient strength, but nevertheless should have a sufficient ductility, such as, for example, bearing mechanical structures, components for baking ovens or similar arrangements with high thermal stresses, and the like. The achievable strength, as well as the ductility of the deposited layer, can be adjusted over a relatively wide range, as will be explained in greater detail in the text below, by a variation of the parameters of the method.

The present invention is also directed to a special galvanic bath for the galvanic deposition of nickel or nickel alloys or cobalt or cobalt alloys with an electrolyte, having

- at least one contoured anode, the contour of which is fitted to the contour of a deposition body;
- a device for triggering the anode and the cathode of the bath with periodic current pulses;
- current restrictors for shielding the deposition body at least partly;
- a filtering device for filtering the electrolyte; and
- a circulating device for circulating the electrolyte, having at least one circulating pump and nozzles for recycling the electrolyte into the bath.

This galvanic bath can be used with the aforementioned method. However, the aforementioned method can also be realized in differently constructed galvanic baths, which are suitably adapted.

Other embodiments of this special bath can be accomplished by an appropriate adaptation to the method according to the present invention. For example, the at least one contoured anode may be constructed as a contoured container that can be filled with bodies of nickel or cobalt or a nickel alloy or a cobalt alloy.

Several anodes may be disposed in the bath, only the anode closest to the deposition body being constructed as a contoured anode. Of course, this also means that the remaining anodes have some contour. However, only the contour of that anode that is closest to the deposition body is fitted to the contour of the deposition body. In this connection, the contouring may extend only in one spatial direction, such as the longitudinal direction of the anode, or it may also extend in more than one spatial direction, for example, perpendicularly to the longitudinal direction.

Furthermore, the purifying device may comprise a filtering device, particularly an activated charcoal filter. Thus, suspended particles as well as undesirable extraneous elements can be removed from the electrolyte.

Other objects, advantages and novel features of the present invention will become apparent from the following detailed description of the present invention when considered in conjunction with the accompanying drawings

BRIEF DESCRIPTION OF THE DRAWINGS

FIG. 2 shows the construction of a bath according to the present invention; and FIG. 3 shows a plan view of an embodiment of a bath according to the present invention.

DETAILED DESCRIPTION OF THE DRAWINGS

Figure 1:
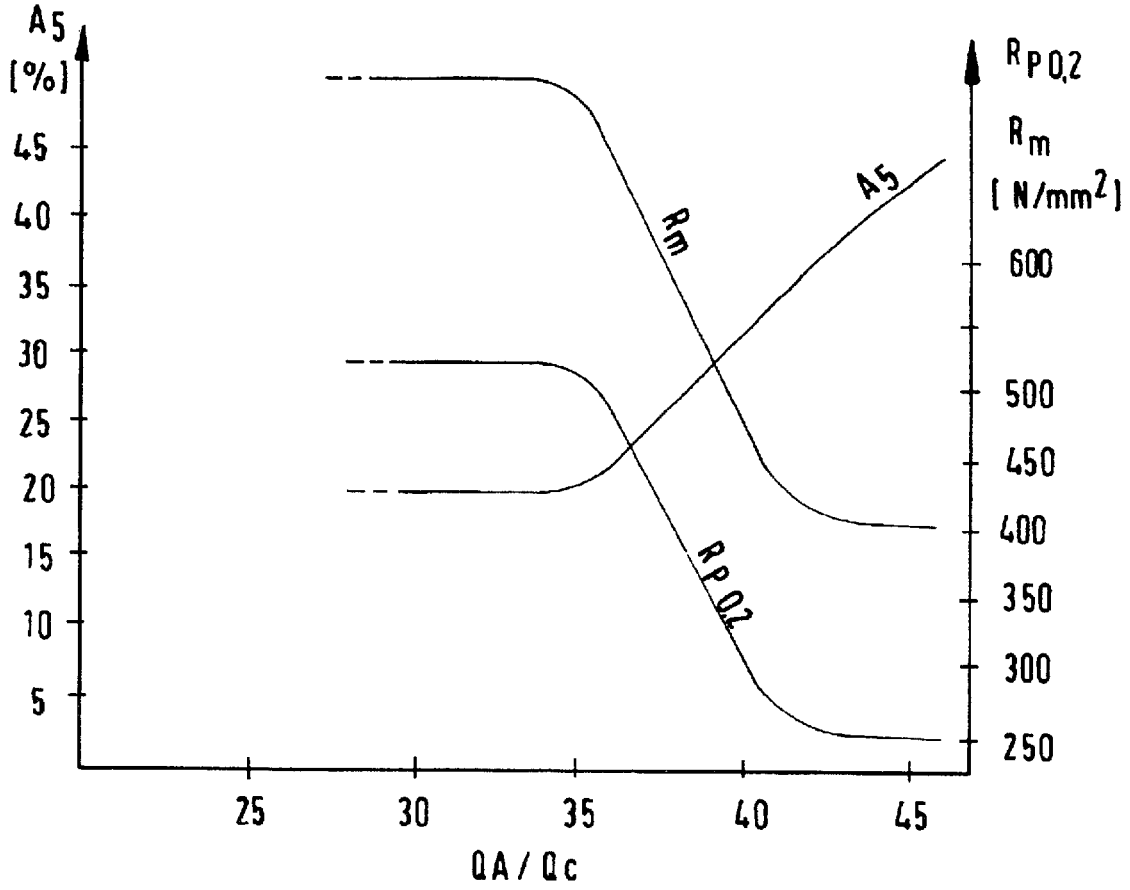
FIG. 1 shows the dependence of the strength and ductility of the deposited layer on the charge ratio $Q_A/Q_C$ in a range of current density ratios $I_A/I_C$.

A galvanic bath with an electrolyte, which contains nickel compounds, is provided within the scope of the following example. However, a galvanic bath with cobalt compounds is also conceivable. For this purpose, in accordance with electrolytes, known from the art, such as nickel sulfate and nickel chloride or also nickel sulfamate and nickel chloride, can be provided as nickel compounds and the corresponding sulfates, sulfamates or chlorides of cobalt as cobalt compounds. Additional additives can also be provided in the electrolyte, such as the sulfonated naphthalene cited in European Patent 0 835 335 or German Patent 22 18 967 or the additives disclosed in the U.S. Pat. No. 2,470,775 in column 3, paragraph 2.

For the deposition, the so-called pulse-plating method is used, for which the anodes and cathodes of the bath are acted upon with periodic current pulses. Further parameter ranges are disclosed in the above references, from which the special settings for the method, especially for selecting the current densities and pulse durations, can be selected. However, it has turned out that the ability to weld the galvanically produced layer cannot be achieved with such parameter values, since the layers, deposited in this manner, do not satisfy the necessary requirements with regard to strength and ductility.

These necessary strengths can only be achieved if the $I_A/I_C$ ratio of the anode current density $I_A$to the cathode current density $I_C$ is larger than 1 and smaller than 1.5 an the charge ratio $Q_A/Q_C=T_AI_A/T_CI_C$ of the charge $Q_A$, transported during an anode pulse of duration $T_A$, to the charge $Q_C$, transported during a cathode pulse of $Q_C$, is between 30% and 45%. Better results are achieved if the $I_A/I_C$ ratio is between 1.2 and 1.45 and the best results are obtained for ratio between 1.3 and 1.4, the charge ratio $Q_A/Q_C=T_AI_A/T_CI_C$ in each case being between 35% and 40%. It has therefore turned out that the ratios, $I_A/I_C$ and $Q_A/Q_C$, cannot be selected at random if the desired advantageous properties of the deposited layer are to be achieved. Instead, these properties are attained only for a particular range of values for the ratio $I_A/I_C$, to which range of values for the ratio $Q_A/Q_C$is coupled. This is fulfilled, in particular, for the range of values according to the present invention.

FIG. 1 describes the dependence of the apparent limit of elasticity (0.2×the yield strength) $R_{p0.2}$, the strength $R_m$, as well as the ductility $A_5$ of a nickel lay on the charge ratio $Q_A/Q_C$ for the current density ratios $I_A/I_C$ of between 1.3 and 1.4. It can be seen here that, with a charge ratio between 35% and 40%, the strengths and the ductility vary within an average range of values, at is, an optimum equalization is found between the ductility and strength of the deposited layer. If the charge ratio is increased, the ductility continues to increase. At the same time, however, the strength declines, so that e mechanical stability of the deposited layer is not adequate. On the other and, if the charge ratio is decreased further, the strength increases. However, the ductility decreases, which means that the deposited layer becomes very brittle and the danger of material breakages exists especially in the region of welded seams, in which material shrinkage and therefore thermomechanical stresses of the layer occur during welding. The values also become correspondingly more disadvantageous if the current density ratio is increase or decreased. A similar behavior is expected for cobalt and cobalt alloys.

FIG. 2 diagrammatically shows the construction of a bath according to the present invention. The bath is filled with an electrolyte. A deposition body 2, such as a combustion chamber of a rocket engine, is in a bath 1. A coating, for example of nickel, is to be produced galvanically on this deposition body. For this purpose, at least one anode 3 is inserted in the bath 1. The anode 3 is contoured in such a manner that it fits the contour of the deposition body 2. The contouring may extend only in one spatial direction, for example, in the longitudinal direction of the anode 3. It may also extend in more than one spatial direction, for example, in a direction perpendicular to the longitudinal direction as well. For reasons of simplification, only a single anode 3 is shown in FIG. 2.

However, FIG. 3 shows a possible arrangement of several anodes 3*a,* 3*b* in a bath 1. Anodes 3*a,* which are closest to the deposition body, are constructed as contoured anodes, since the positive effect of contouring becomes most noticeable there. Anodes 3*b,* which are further removed, can be constructed as universally usable anodes and, in the simplest case, as flat anodes, for which any standardized anode shape can be used. Consequently, only the anodes 3*a,* which are closest to the deposition body 2, are to be fitted optionally to the special shape of different deposition bodies 2.

The contoured anode 3 in FIG. 2 may be formed by a contoured container 8, which is constructed, for example, as a titanium basket and is permeable to the nickel ions that are required for the deposition. The container 8 can also be surrounded by additional envelopes, which are also permeable to nickel ions. The nickel is introduced into the container 8 in the form of small nickel bodies 9 and can therefore be refilled in an uncomplicated manner if the nickel is consumed stepwise during the deposition process. The anode 3, as well as the deposition body 2, which acts as cathode, can be triggered with periodic current pulses over a device 4 for implementing the pulse-plating method that has been described.

Current restrictors 5 may be provided, which shield certain regions of the deposition body 2 at least during a portion of the deposition process. In the case of FIG. 2, the edges of the deposition body 2 are shielded, since increased deposition of nickel would take place in these regions without shielding and thus lead to an inhomogeneous deposition over the whole of the deposition body 2. The current restrictors 5 may be provided as rings, which are disposed concentrically around the edge regions of the deposition body 2. These regions can be shielded at least during a certain period by the current restrictors 5, so that a more homogeneous deposition over the whole of the deposition body 2 can be achieved for the duration of the deposition. In the case of a different form of deposition body 2, corresponding regions, in which there is increased deposition, such as elevations, can be shielded analogously. With that, an otherwise lesser deposition in other regions, such as depressions, can be compensated for. The current restrictors 5 may be disposed movably or also completely removably in the bath 1.

Before the deposition, the electrolyte may be cleaned. This can be done especially with the help of activated charcoal in a concentration preferably of 1 g/L to 3 g/L as well as with 30% hydrogen peroxide in a concentration preferably of 1 mL/L to 2 mL/L. In principle, higher and lower concentrations are also possible.

Interfering extraneous elements and suspended particles may be removed from the electrolyte during the deposition process with a cleaning device 6. This removal is accomplished with the help of activated charcoal filters 10 and a selective bath 11, which is shown only diagrammatically in FIG. 2. The electrolyte is discharged from and recycled to the bath by suitable feeding and discharging pipelines. A particularly high purity of the electrolyte and the almost complete freeing from extraneous elements, especially from extraneous metals, as well as from suspended particles, can be achieved. The proportion of extraneous elements, such as Fe, Cu, Cr, Al, Zn and Co in the nickel bath can be reduced by this part of the method to values below 0.1 mg/L. This benefits the properties of the deposited layer additionally, since the ductility of the deposited layer is improved even further by such a reduction in the proportion of extraneous elements and, in addition, a continued high or even higher strength of the deposited layer is guaranteed.

In addition, the bath may have a circulating device 13, which is shown diagrammatically in FIG. 2, for circulating the electrolyte. This device consists of a circulating pump 12 and suitably constructed and suitably disposed nozzles 7 for returning the electrolyte. The recycling of electrolytes into the bath in this form with the help of nozzles 7 can be utilized additionally to favor circulation of the electrolyte in the bath 1 and to supply the electrolytes selectively to the deposition body 2. The suitable arrangement and alignment of the nozzles 7 is to be selected so that these requirements are fulfilled. In principle, the purifying device 6 and the circulating device 13 can be combined in a single device, for example, by recycling the electrolytes, cleaned in the cleaning device 6, into the bath 1 with the help of nozzles 7.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A method for galvanically depositing nickel, cobalt, nickel alloys, or cobalt alloys, comprising:

subjecting at least one anode and at least one cathode in a galvanic bath with periodic current pulses, said galvanic bath comprising an electrolyte containing nickel compound or cobalt compounds; and depositing nickel, cobalt, nickel alloys, or cobalt alloys on a deposition body;

wherein a $I_A/I_C$ ratio of an anode current density $I_A$ to a cathode current density $I_C$ is selected to be greater than 1 and smaller than 1.5, said anode current density $I_A$ and cathode current density $I_C$ being defined as current densities with respect to said deposition body during periodic pulses where said deposition body serves as anode and cathode respectively, and wherein a charge ratio $Q_A/Q_C=T_AI_A/T_CI_C$ of a charge $Q_A$, transported during an anode pulse of duration $T_A$, to a charge $Q_C$, transported during a cathode pulse of duration $T_C$, is between 30% and 45%.

2. A method according to claim 1, wherein the $I_A/I_C$ ratio is between 1.2 and 1.45.

3. A method according to claim 1, wherein the $I_A/I_C$ ratio is between 1.3 and 1.4.

4. A method according to claim 1, wherein the at least one anode is contoured to fit to a contour of the deposition body.

5. A method according to claim 4, wherein several anodes are provided in the bath and the at least one contoured anode is one of the anodes disposed closest to the deposition body.

6. A method according to claim 4, wherein, the at least one contoured anode comprises a contoured container that is permeable to the nickel, cobalt, nickel alloy, or cobalt alloy that is to be deposited and is filled with bodies comprising nickel or cobalt or a nickel alloy or a cobalt alloy.

7. A method according to claim 4, wherein that at least one contoured anode comprises a solid electrode body that has at least a coating of the nickel or cobalt or of the nickel alloy or the cobalt alloy that is to be deposited.

8. A method according to claim 1, further comprising shielding the deposition body by current restrictors at least during a portion of the depositing.

9. A method according to claim 8, wherein the current restrictors are disposed in regions of the deposition body in which deposition takes place preferentially.

10. A method according to claim 1, further comprising cleaning the electrolyte at least one of before the start the depositing of or during the depositing.

11. A method according to claim 10, wherein 0.5 g/L to 5 g/L of activated charcoal and 0.5 mL/L to 3 mL/L of 30% hydrogen peroxide are used to clean the electrolyte before the start of the deposition.

12. A method according to claim 10, wherein 1 g/L to 3 g/L of activated charcoal and 1 L/ to 2 mL/L of 30% hydrogen peroxide are used to clean the electrolyte before the start of the deposition.

13. A method according to claim 10, wherein, for cleaning the electrolyte during the depositing, the electrolyte is filtered and extraneous elements are removed from the electrolyte with at least one selective bath.

14. A method according to claim 13, wherein the electrolyte is filtered with an activated charcoal filter.

15. A method according to claim 1, wherein, at least during a portion of the depositing, the electrolyte is circulated with at least one circulating device and recycled into the galvanic bath by nozzles.

16. A method according to claim 15, wherein the nozzles are disposed in the bath in such a manner that the bath is circulated or a flow of electrolyte is directed onto the deposition body.

17. A method according to claim 1, wherein the deposition body is part of a rocket engine.

18. A method according to claim 17, wherein the part is at least one of an injection head, a combustion chamber, or a thrust nozzles.

19. A method according to claim 1, wherein the charge ratio $Q_A/Q_C=T_AI_A/T_CI_C$ is between 35% and 40%.

* * * * *